US007125143B2

(12) United States Patent
Hacker

(10) Patent No.: US 7,125,143 B2
(45) Date of Patent: Oct. 24, 2006

(54) LED MODULE

(75) Inventor: Christian Hacker, Regensburg (DE)

(73) Assignee: Osram Opto Semiconductors GmbH, Regensburg (DE)

( * ) Notice: Subject to any disclaimer, the term of this patent is extended or adjusted under 35 U.S.C. 154(b) by 113 days.

(21) Appl. No.: 10/901,770

(22) Filed: Jul. 29, 2004

(65) Prior Publication Data

US 2005/0052378 A1 Mar. 10, 2005

(30) Foreign Application Priority Data

Jul. 31, 2003 (DE) ..... 103 35 077

(51) Int. Cl.
*F21V 9/00* (2006.01)

(52) U.S. Cl. ..... 362/231

(58) Field of Classification Search ..... 362/231, 362/251

See application file for complete search history.

(56) References Cited

U.S. PATENT DOCUMENTS

| | | | | |
|---|---|---|---|---|
| 6,066,861 | A * | 5/2000 | Hohn et al. | 257/99 |
| 6,149,283 | A * | 11/2000 | Conway et al. | 362/236 |
| 6,345,903 | B1 * | 2/2002 | Koike et al. | 362/249 |
| 6,357,889 | B1 * | 3/2002 | Duggal et al. | 362/84 |
| 6,478,447 | B1 * | 11/2002 | Yen | 362/231 |
| 6,890,085 | B1 * | 5/2005 | Hacker | 362/231 |
| 2003/0123254 | A1 * | 7/2003 | Brass et al. | 362/231 |
| 2006/0007112 | A1 * | 1/2006 | Park | 345/102 |
| 2006/0022211 | A1 * | 2/2006 | Yatsuda et al. | 257/98 |

* cited by examiner

*Primary Examiner*—Renee Luebke
*Assistant Examiner*—Julie A. Shallenberger
(74) *Attorney, Agent, or Firm*—Fish & Richardson P.C.

(57) ABSTRACT

A LED module having a plurality of LEDs, comprising mixed-light LEDs and additional LEDs, wherein each of the additional LEDs (2) has a plurality of LED chips (6, 7, 8) having different emission wavelengths, which, in each instance, are arranged in a common housing.

13 Claims, 3 Drawing Sheets

LED MODULE

TECHNICAL FIELD

The invention relates to an LED module having a plurality of LEDs, which comprises mixed-light LEDs and additional LEDs.

BACKGROUND

Within the scope of the present invention, a mixed-light LED is understood to mean a component that comprises at least one LED chip and one conversion element, wherein the conversion element converts light emitted by the LED chip into light having a different, generally a greater wavelength. By means of the simultaneous perception of the light emitted by the LED chip and the light converted by the conversion element, the impression of mixed-color light is produced.

Such mixed-light LEDs are frequently configured as white-light LEDs. In this connection, a luminous substance is excited by means of an LED chip that emits in the blue spectral range; this substance in turn emits light in the yellow-orange spectral range. The mixture of blue and yellow-orange light is perceived as white light.

However, the spectrum of such a white-light LED clearly differs from a conventional white-light source such as an incandescent bulb, for example, since a conventional white-light source has a rather broad spectral distribution, which covers large parts of the visible spectral range, while a white-light LED of the type described above primarily shows blue and yellow-orange spectral components. This difference is particularly noticeable in connection with the different color reproduction of a white-light LED, on the one hand, and a conventional white-light source such as an incandescent bulb, on the other hand.

An improvement of the color reproduction can be achieved in that in the case of an LED module, both white-light LEDs and color LEDs are used, wherein the color LEDs supplement the spectral components that are missing in the spectrum of the white-light LEDs.

In similar manner, it can also be necessary, in the case of other non-white mixed-light LEDs having a conversion element, to supplement missing spectral components. However, here it is less the color reproduction than the desired exact color location that stands in the foreground. It is fundamentally possible to implement a predetermined color location of the mixed-color light generated by a mixed-light LED, by means of suitable coordination and mixing of luminous substances. However, the effort and expense for this is relatively great, since a special casting mass containing the corresponding luminous substances generally has to be produced and processed. In the automated production of large numbers of LEDs, in particular, this method of procedure is disadvantageous for economic reasons.

SUMMARY

It is the task of the invention to create an LED module that is easy to produce, in technical terms, wherein the color location of the emitted light can be freely adjusted within broad ranges. In particular, a white-light LED module having a high level of color reproduction is to be implemented.

This task is accomplished by means of an LED module in accordance with claim 1. Advantageous further developments of the invention are the object of the dependent claims.

According to the invention, an LED module is provided with a plurality of LEDs, comprising mixed-light LEDs and additional LEDs, wherein each of the additional LEDs has a plurality of LED chips having different emission wavelengths, which, in each instance, are arranged in a common housing.

Using several LED chips having different emission wavelengths, it is possible to cover a broad range of the color space, in an advantageous manner, so that in the case of the invention, the color location of the light emitted by the LED module can be adjusted within broad ranges, and/or, using an additional LED, several different spectral components can be added to the spectrum of the mixed-light LED at the same time.

LEDs having a plurality of LED chips in a common housing can be produced in a relatively inexpensive manner. Furthermore, as compared with individual LEDs, each having one LED chip, the number of LEDs to be installed is advantageously reduced.

In a preferred embodiment of the invention, the mixed-light LEDs comprise an LED chip as well as a conversion element that converts the radiation emitted by the LED chip into radiation of a different, particularly a longer, wavelength. The conversion element can surround the LED chip in the form of a casting mass, for example, in which one or more suitable luminous substances for converting the light emitted by the LED chip are distributed.

It is particularly preferred for the invention to use white-light LEDs as mixed-light LEDs, to form a white-light LED module. By means of the additional LEDs, the spectrum of the white-light LEDs can be supplemented in such a manner that the spectrum of the light emitted as a whole (total spectrum) approximately corresponds to the spectrum of a Planck radiator. In this way, advantageously high color reproduction is achieved.

Furthermore, depending on how the LED chips in the additional LEDs are controlled, the total spectrum can be varied in such a manner that it corresponds to a Planck radiator having a different color temperature, in each instance. It is advantageous that in this way, a predetermined color temperature can be adjusted for the light emitted by the LED module, by controlling the LEDs.

In addition or alternatively, the color reproduction index can be adjusted and/or optimized, by means of suitably controlling the LED chips of the additional LEDs. A high color reproduction index is advantageous, on the one hand, in order to avoid color distortions in the lighting of an object. Particularly in the case of lighting with white light, the color impression should, as a rule, not be dependent on the technical implementation of the light source. On the other hand, a minimum color reproduction index is required by law for certain applications, so that in the case of the invention, the high color reproduction index results in an advantageously broad area of application, particularly also in fields in which white-light LED modules could not be used until now.

Additional characteristics, advantages, and practical features of the invention are evident from the following description of an exemplary embodiment, in combination with FIGS. 1 and 2.

DETAILED DESCRIPTION

Figure 1:
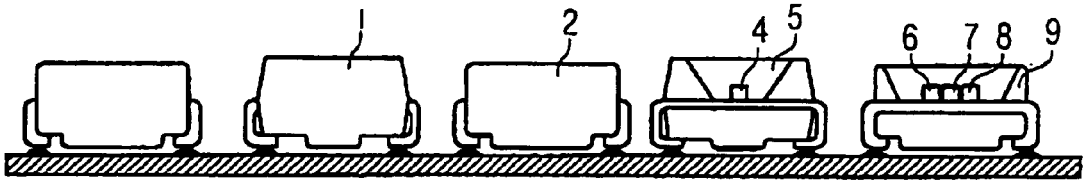
FIG. 1 a schematic sectional view of an exemplary embodiment of an LED module according to the invention, FIG. 2 a schematic top view of the exemplary embodiment of an LED module according to the invention, FIG. 3 a first white-light range in the CIE Chromaticity Diagram, and FIG. 4 a second white-light range in the CIE Chromaticity Diagram.
Figure 2:
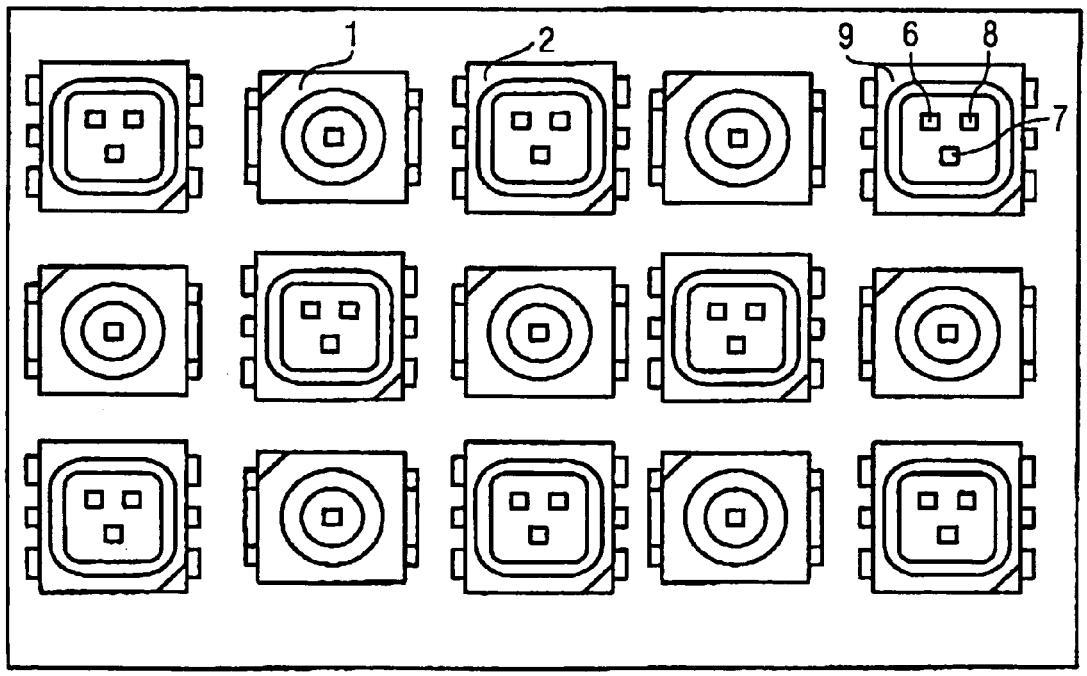

The LED module shown in FIGS. 1 and 2 comprises a plurality of mixed-light LEDs 1 and additional LEDs 2, in each instance, which are installed on a common carrier 3, for example, a circuit board having corresponding conductor structures (not shown) for the electrical supply and for controlling the LEDs.

Each of the mixed-light LEDs has an LED chip 4, which is surrounded by a conversion element 5 for converting the radiation emitted by the LED chip into radiation of a different wavelength. For example, a casting mass into which a suitable luminous substance is introduced and which surrounds the LED chip can serve as the conversion element. The luminous substance is excited by the light emitted by the LED chip and, upon returning from the excited state into a lower energy state, emits light having a different wavelength from that of the LED chip.

In the additional LEDs 2, three LED chips 6, 7 and 8 are installed in a common housing 9, in each instance. The LED chips 6, 7 and 8 have different emission wavelengths. By means of these additional LEDs, those spectral components that are missing in the emission spectrum of the mixed-light LEDs or are not present in sufficient intensity are added to the total spectrum.

Preferably, the LED module is structured as a white-light LED module. Here, white-light LEDs are used as mixed-light LEDs 1, for example, LEDs of the type LW T673 (manufactured by Osram Opto Semiconductors GmbH). These LEDs contain a blue-emitting semiconductor chip 4 on an InGaN basis, which is covered with a casting mass 5 containing a luminous substance. The luminous substance emits yellow-orange light when it is excited with the blue light, so that white light results, as a whole.

LEDs of the type LATB G66B (manufactured by Osram Opto Semiconductors GmbH) are suitable as additional LEDs 2. These LEDs each contain an LED chip that emits in the orange spectral range, having an emission wavelength at 617 nm, an LED chip that emits in the green spectral range, having an emission wavelength at 528 nm, and an LED chip that emits in the blue spectral range, having an emission wavelength at 460 nm. A large part of the color space is covered by these three colors, so that by means of suitable separate control and/or dimming of the individual LED chips, the color location of the light emitted by the LED module can be precisely adjusted. It is advantageous that this color location does not have to be established during assembly of the LEDs, but rather can still be varied during operation.

It is particularly advantageous that by means of the said LED chips, the spectral components that are missing in the spectrum of the white-light LEDs, in comparison with a Planck radiator, can be supplemented, to the greatest possible extent, so that the total spectrum comes very close to that of a Planck radiator. By means of suitable control, the color temperature of the light generated by the LED module can also be varied, within broad limits.

It is advantageous that a high color reproduction index is achieved with the invention. Thus, for example, color reproduction indices of greater than or equal to 90 can be achieved using an LED module according to the invention, which thereby reaches the highest color reproduction class.

The color reproduction index of a light source indicates how much the colors of a specific object are distorted in the case of lighting with the light source. For this purpose, the spectrum of the light reflected by the object is quantitatively compared with the spectrum of the reflected light in the case of lighting with a reference light source, and the deviation is stated as the color reproduction index, in other words, a numerical value that is a maximum of 100 (when the spectra are in agreement). The color reproduction index is standardized in DIN 6169.

While LED modules that contain only white light generally have a clearly lower color reproduction index, because of missing spectral components, an advantageously high color reproduction index in the stated range can be achieved with the invention. In addition, by means of separate control of the LED chips of the additional LEDs, the color reproduction index can be adjusted to a predetermined value in operation, i.e., can be optimized to the highest possible value.

In a modification of the exemplary embodiment, the additional LEDs have LED chips that emit in a different green or green-blue spectral range, approximately at 505 nm, for example, instead of the LED chips that emit in the blue spectral range. With this modification, a more precise adaptation of the total spectrum to a predetermined spectrum, such as that of a Planck radiator, having a predetermined color temperature, can be achieved, if necessary, since the additional LEDs make another adjustable spectral range available. The blue component in the spectrum of the additional LEDs that is replaced in this connection is already generated in sufficient amount by the LED chip of the white-light LEDs, in any case. However, such additional LEDs, as compared with the additional LEDs already described, generally represent special productions having a limited field of use and higher production costs.

It should be noted that white light within the scope of the invention is understood to mean not only pure white light having a color location $x=y=1/3$ but also whitish light, for example, having a touch of color. In case of doubt, the white-light range according to the definition in DIN 6163 Part 5 (signal transmitter, road) or the ranges shown in FIGS. 3 and 4 can be used as a reference.

Figure 3:
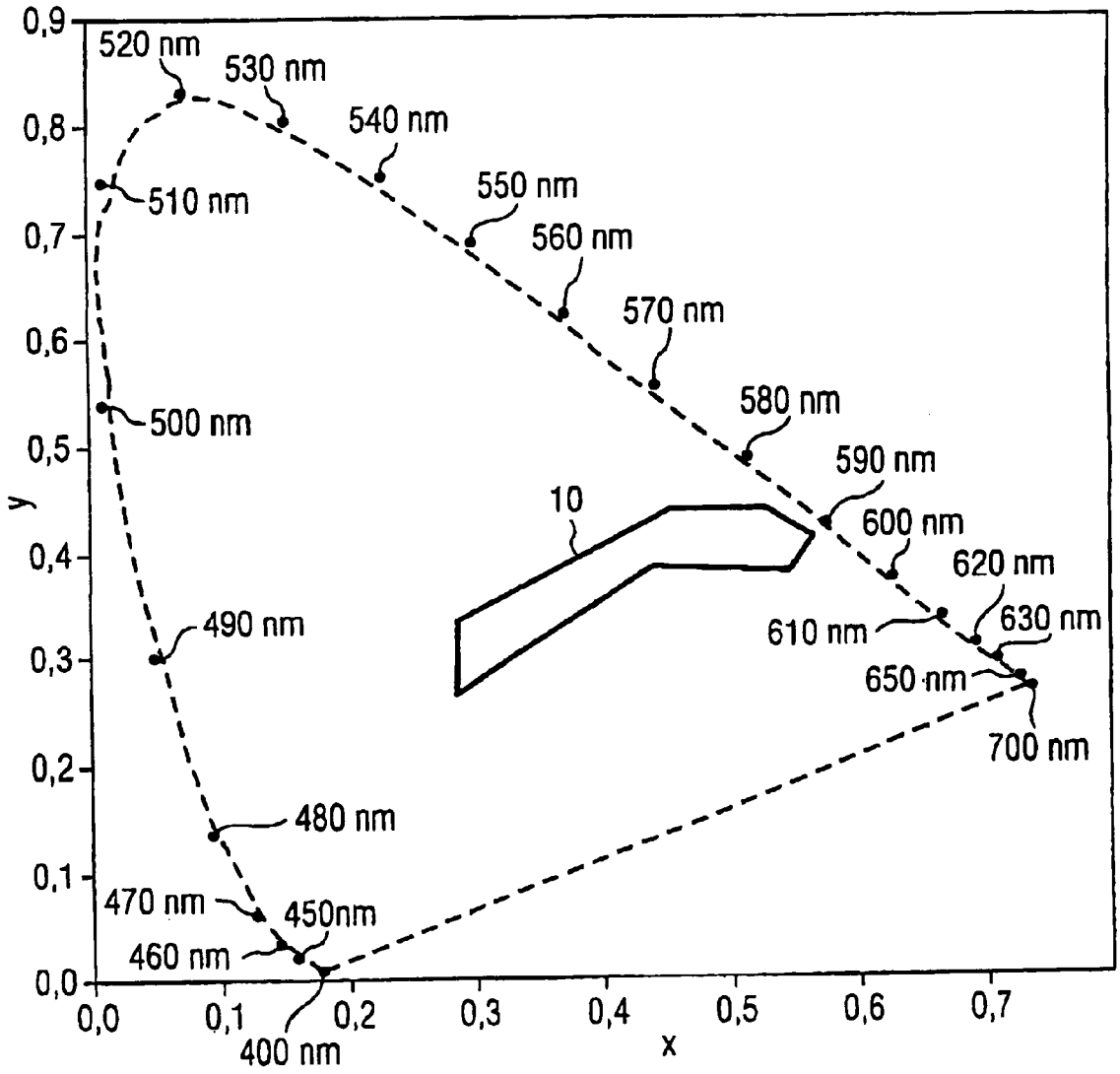
Figure 4:
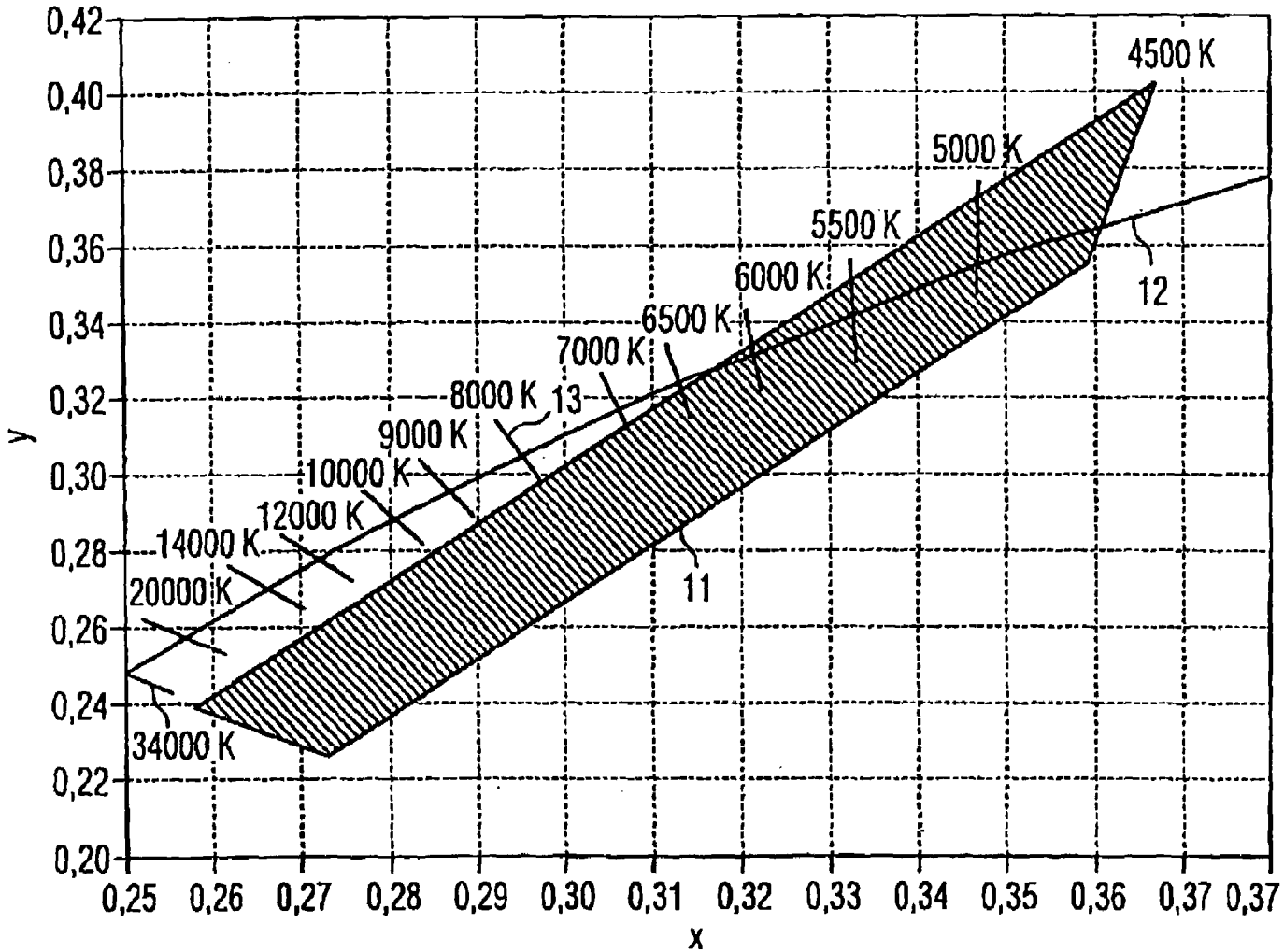

In FIG. 3, the white-light range 10 is reproduced according to the definition of the CIE in the CIE 1931 Chromaticity Diagram. FIG. 4 shows an excerpt of the CIE 1931 Chromaticity Diagram having a modified white-light range 11, which is adapted to the special features of LED lighting modules. For a comparison, the color location 12 of a Planck radiator for different color temperatures, as well as segments 13 of the related Judd straight line, are indicated.

Light whose color coordinates x and y lie at least in one of the stated white-light ranges is considered to be white light within the scope of the invention.

The explanation of the invention using the exemplary embodiment is not to be understood as restricting the invention to this embodiment. Instead, the invention comprises all combinations of the characteristics disclosed in the description, even if these are not explicitly claimed.

The present patent application claims the priority of the German patent application DE 103 35 077.2-33, the disclosure content of which is hereby incorporated by reference.

The invention claimed is:

1. A LED module comprising:

a plurality of mixed-light LEDs, each mixed-light LED includes a corresponding LED chip and a conversion element configured to convert at least a portion of the radiation emitted by the corresponding LED chip into radiation of a different wavelength; and a plurality of additional LEDs, each of the additional LEDs includes a plurality of LED chips arranged in a common housing, each of the plurality of LED chips having different emission wavelengths.

2. LED module according to claim 1, wherein the conversion element surrounds the LED chip.

3. LED module according to claim 1, wherein the conversion element contains at least one luminous substance that is distributed in a casting mass.

4. LED module according to claim 1, wherein the LED chips of the additional LEDs can be controlled separately.

5. LED module according to claim 1, wherein the mixed-light LEDs are white-light LEDs.

6. LED module according to claim 5, wherein the LED module emits light of a predetermined color temperature and that the color temperature is adjustable by means of a control device of the additional LEDs.

7. LED module according to claim 5, wherein the LED module emits light of a predetermined color reproduction value and that the color temperature is adjustable by means of a control device of the additional LEDs.

8. LED module according to claim 1, wherein at least one LED chip of the additional LEDs emits in the red spectral range.

9. LED module according to claim 1, wherein at least one LED chip of the additional LEDs emits in the orange or yellow spectral range.

10. LED module according to claim 1, wherein at least one LED chip of the additional LEDs emits in the green or blue-green spectral range.

11. LED module according to claim 1, wherein at least one LED chip of the additional LEDs emits in the blue spectral range.

12. LED module according to claim 1, wherein the LED module emits light having a predetermined spectrum, wherein the additional LEDs supplement the spectral components missing in the spectrum of the mixed-light LEDs.

13. LED module according to claim 1, wherein the predetermined spectrum corresponds to the spectrum of a Planck radiator at a predetermined temperature.

* * * * *